US005131174A

United States Patent [19]

Drew et al.

[11] Patent Number: 5,131,174

[45] Date of Patent: Jul. 21, 1992

[54] SELF-REINITIALIZING PADDING DEVICE

[75] Inventors: Terrence M. Drew; Chris A. Hanson; Alden B. Hanson, all of Boulder, Colo.

[73] Assignee: Alden Laboratories, Inc., Boulder, Colo.

[21] Appl. No.: 573,490

[22] Filed: Aug. 27, 1990

[51] Int. Cl.[5] ..... A43B 21/28

[52] U.S. Cl. ..... 36/35 B; 36/35 R; 36/29

[58] Field of Search ..... 2/413, 16, 22; 36/28, 36/71, 29, 88, 93, 35 B, 35 R

[56] References Cited

U.S. PATENT DOCUMENTS

| | | | |
|---|---|---|---|
| D 297,381 | 8/1988 | Sugiyama | D2/314 |
| D. 297,980 | 10/1988 | Sugiyama | D2/314 |
| D. 300,084 | 3/1989 | Ito et al. | D2/264 |
| D. 300,085 | 3/1989 | Ito et al. | D2/264 |
| 508,034 | 11/1893 | Moore . | |
| 586,155 | 7/1897 | Bascom . | |
| 850,327 | 4/1907 | Tauber . | |
| 900,867 | 10/1908 | Miller . | |
| 1,069,001 | 7/1913 | Guy . | |
| 1,517,171 | 11/1924 | Rosenwasser . | |
| 1,605,985 | 11/1926 | Rasmussen . | |
| 2,080,499 | 5/1937 | Nathansohn . | |
| 2,177,116 | 10/1939 | Persichino . | |
| 2,532,742 | 12/1950 | Stoiner . | |
| 2,600,239 | 6/1952 | Gilbert . | |
| 2,605,560 | 8/1952 | Gouabault . | |
| 3,237,319 | 3/1966 | Hanson | 36/2.5 |
| 3,402,411 | 9/1968 | Hanson | 12/142 |
| 3,635,849 | 1/1972 | Hanson | 260/2.5 |
| 3,713,640 | 1/1973 | Margan | 2/413 X |
| 3,765,422 | 10/1973 | Smith | 128/594 |
| 3,871,117 | 3/1975 | Richmond et al. | 36/43 |
| 4,038,700 | 8/1977 | Györy | 2/413 |
| 4,038,762 | 8/1977 | Sawn, Jr. | 36/89 |
| 4,083,127 | 4/1978 | Hanson | 36/93 |
| 4,100,686 | 7/1978 | Sgarlato et al. | 36/29 |
| 4,108,928 | 8/1978 | Swan, Jr. | 264/26 |
| 4,144,658 | 3/1979 | Swan, Jr. | 36/117 |
| 4,211,236 | 7/1980 | Krinsky | 128/594 |
| 4,217,705 | 8/1980 | Donzis | 36/29 |
| 4,219,945 | 9/1980 | Rudy | 36/29 |
| 4,223,457 | 9/1980 | Borgeas | 36/35 |
| 4,229,546 | 1/1980 | Swan, Jr. | 521/55 |
| 4,237,625 | 12/1980 | Cole et al. | 36/28 |
| 4,243,754 | 1/1981 | Swan, Jr. | 521/55 |

(List continued on next page.)

FOREIGN PATENT DOCUMENTS

| | | |
|---|---|---|
| 2460034 | 6/1976 | Fed. Rep. of Germany . |
| 2800359 | 7/1979 | Fed. Rep. of Germany . |
| 2050145 | 1/1981 | United Kingdom . |

*Primary Examiner*—Paul T. Sewell
*Assistant Examiner*—Ted Kavanaugh
*Attorney, Agent, or Firm*—Sheridan, Ross & McIntosh

[57] ABSTRACT

A self-reinitializing padding device having at least two fluidly connected chambers which contain flowable material for use in applications where it is desirable to reinitialize the padding device for subsequent use in absorbing and/or distributing impact forces. One application for which the padding device is particularly well suited is as a foot padding device in footwear. In this application, the device provides improved absorption and distribution of impact forces generated when the footwear contacts a surface, as well as improved lateral support for the foot. In a preferred embodiment, a primary chamber is positioned under the area to be padded, and a plurality of secondary chambers, each fluidly connected to the primary chamber, are positioned around the padded area. The impact force of the user's foot deforms the primary chamber, thereby forcing some of the flowable material contained therein to flow into the secondary chambers. The rate of deformation of the primary chamber exceeds the flow rate into the secondary chambers, thereby providing a cushioning effect. When the portion of the footwear coinciding with the primary chamber loses contact with the ground, the force is removed from the primary chamber, thereby allowing the secondary chambers to contract and force some of the flowable materials contained therein back into the primary chamber to reinitialize the padding device.

28 Claims, 2 Drawing Sheets

OTHER PUBLICATIONS

| | | | |
|---|---|---|---|
| 4,255,202 | 3/1981 | Swan, Jr. | 106/122 |
| 4,263,728 | 4/1981 | Frecentes | 36/129 |
| 4,287,613 | 8/1981 | Schulz | 2/413 |
| 4,342,157 | 8/1982 | Gilbert | 36/28 |
| 4,358,902 | 11/1982 | Cole et al. | 36/28 |
| 4,370,754 | 2/1983 | Donzis | 2/16 X |
| 4,414,760 | 11/1983 | Faiella | 36/28 |
| 4,446,634 | 5/1984 | Johnson et al. | 36/29 |
| 4,458,430 | 7/1984 | Peterson | 36/28 |
| 4,506,461 | 3/1985 | Inohara | 36/29 |
| 4,566,137 | 1/1986 | Gooding | 2/413 |
| 4,567,677 | 2/1986 | Zona | 36/43 |
| 4,577,417 | 3/1986 | Cole | 36/29 |
| 4,610,099 | 9/1986 | Signori | 36/3 |
| 4,662,087 | 5/1987 | Beuch | 36/71 X |
| 4,674,206 | 6/1987 | Lyden | 36/88 |
| 4,700,403 | 10/1987 | Vacanti | 36/71 X |
| 4,723,322 | 2/1988 | Shelby | 2/16 X |
| 4,744,157 | 5/1988 | Dubner | 36/88 |
| 4,768,295 | 9/1988 | Ito | 36/28 |
| 4,802,289 | 2/1989 | Guldager | 36/43 |
| 4,905,320 | 3/1990 | Squyers, Jr. | 2/22 |
| 4,934,072 | 6/1990 | Fredericksen et al. | 36/29 |
| 4,991,317 | 2/1991 | Lakic | 36/29 X |

SELF-REINITIALIZING PADDING DEVICE

FIELD OF THE INVENTION

This invention relates generally to the field of padding devices, and more particularly, to chambered padding devices which are used to at least partially absorb and/or distribute forces and which are self-reinitializing after removal of at least a portion of the force for subsequent use.

BACKGROUND OF THE INVENTION

A number of padding devices to relieve impact forces are known. For example, walking, jogging, and running generate large forces which are transferred throughout the body to such stress-sensitive areas as the knee and hip joints, as well as the lower back, where they then must be absorbed by the body. However, the origin of impact is the feet, and although quite possibly not as stress-sensitive as the above identified regions, the pressures experienced by the feet are magnified by the impact forces being applied over a relatively small area, typically the ball and heel of the foot. Consequently, there have been numerous attempts to not only reduce the overall stress imposed upon the body, but to also reduce the level of discomfort often experienced by the feet, all by utilizing impact absorbing devices in footwear.

Foam cushions are commonly used in footwear and other articles of clothing for absorbing impact force and can either be built into the footwear or be separately insertable. The basic concept of utilizing extra foam cushioning is that some of the forces of impact will be dissipated or absorbed in compressing the foam cushion. When the force is removed, the foam cushion will theoretically expand, in essence reinitializing itself for repeated absorbtion of impact forces.

There are a wide variety of foams available which have different properties and characteristics. However, foams in general have numerous inherent deficiencies which adversely affect their performance as impact force absorbers. For instance, "soft" foams offer little or no protection and dissipate little if any of the energy transferred at impact since they are easily compressed, and in fact tend to bottom out (fully compress) when subjected to a large force. "Harder" foams, on the other hand, may dissipate more energy by having a higher resistance to compression, but such pads will tend to adversely affect the comfort experienced by the user since there will not be much "give" in the pad, resulting in the impact forces being transferred to the body.

Regardless of the type of foam used as an impact force absorber, there may also be problems with an undesirable increase in the weight, for example, of the shoe in which the pad is used. Moreover, the lateral stability offered by the footwear by use of the additional foam pad may deteriorate since the distance from the ground to the bottom of the foot will quite naturally increase, thereby increasing the possibility of a user injuring an ankle or knee. Furthermore, a natural inherent characteristic of most foams is that over a given number of cycles of compression and expansion, the resiliency will eventually be affected such that the foam will become fatigued and no longer absorb impact forces as effectively as a foam which has not experienced cyclic fatigue.

Because of these types of undesirable characteristics exhibited by foam materials, numerous alternatives for absorbing impact forces have been developed. Instead of using foams as the impact absorbing medium, gases such as air and various liquids have been incorporated into certain configurations to enhance the impact absorbtion and distribution characteristics provided, for example, by footwear padding devices. Some of these alternative methods and devices will be discussed in the following paragraphs.

U.S. Pat. No. 4,263,728 by Frecentese, issued Apr. 28, 1981, discloses a jogging shoe with an adjustable shock absorbing system. The shock absorbing system includes a plurality of inwardly compressible piston-like protrusions on the bottom of the sole which communicate with a single air chamber contained within the sole of the shoe. The air chamber is inflated to an initial pressure by means of a valve which accesses the air chamber from outside the sole of the shoe. In operation, as a person walks, jogs, or runs, the pistonlike protrusions on the bottom of the sole of the shoe individually compress as they contact the ground. This compression of the pistons compresses the air contained within the air chamber which results in the absorbtion and distribution of the impact forces. Although Frecentese discloses a shock absorbing system for footwear, the disclosure is restricted to using air in a single chamber as the shock absorbing medium. Moreover, the disclosure of Frecentese is restricted to a system which is constructed within the sole of the shoe. Consequently, if the shock absorbing system fails, presumably the entire shoe would have to be replaced.

U.S. Pat. No. 4,342,157 by Gilbert, issued Aug. 3, 1982, discloses a shock absorbing system made up of two independent cushions which are both filled with a liquid and a gas, the liquid occupying a majority of the volume of the cushion. These cushions are constructed within the sole of a shoe and are preferably placed in those portions of the shoe coinciding with the heel and ball areas of the foot. The apparent shock absorbing concept desired by Gilbert is simply providing compressible cushions to protect these areas of the foot, the cushions merely being a liquid/gas combination rather than a foam. Although disclosing the use of liquid/gas-filled cushions in footwear, there is no disclosure or suggestion of using any fluid communication between the chambers as a way to absorb and/or distribute impact forces. Furthermore, the disclosure requires that the cushions be constructed within the sole of the shoe. Consequently, if the cushions rupture, the entire shoe would presumably have to be replaced.

U.S. Pat. No. 4,217,705 by Donzis, issued Aug. 19, 1980, discloses a flexible, self-contained, fluid-filled support device for use in footwear. The support device is an insertable cushion which approximates the contour of a foot. The cushion is formed by sealing two plies of material on the periphery and then sealing numerous portions of the cushion interior of the periphery to form a plurality of interconnected chambers. Fluid communication between the chambers is limited to a path around the periphery and is further restricted when the cushion is flexed, which in essence pinches off the flow channels to effectively create a plurality of isolated chambers. Therefore, impact forces are absorbed by deformation of the cushion without utilizing a substantial transfer of fluid to lower pressure regions of the cushion to more effectively absorb and/or distribute impact forces. Moreover, there is no disclosure or suggestion that the individual chambers are capable of a self-pumping action to transfer fluid throughout the pad, instead requiring the application of a force thereon to transfer a limited amount of fluid to other regions of the pad.

U.S. Pat. No. 4,538,902 by Cole et al., issued Nov. 16, 1982, discloses a shock absorbing system having interconnected, fluid-filled chambers which are partially constructed within the sole of the shoe. Although a majority of the chambers are contained within the sole, a portion of each cushion extends beneath the sole and thus actually comes into contact with the ground. One embodiment suggests positioning one chamber to coincide with the heel and two chambers to coincide with the ball area of the foot, the heel chamber being fluidly communicable with the two ball area chambers. The shock absorbing function disclosed by Cole et al. begins with the heel impacting the heel chamber. This impact deforms the heel chamber and forces some of the fluid contained therein to flow into the two ball area chambers. When the ball area chambers strike the ground, these chambers deform and some of the fluid contained therein is forced to flow back into the heel chamber. Consequently, fluid is transferred from front to back to absorb and distribute the impact forces. Although disclosing an interconnected, multi-chambered, fluid-filled shock absorbing system, Cole et al. do not disclose or suggest that any of the chambers themselves exhibit a self-pumping action, instead requiring the application of a force to transfer fluid to the other chamber or chambers. Moreover, the disclosure is restricted to a system which is constructed within the sole of the shoe. Furthermore, Cole et al. do not disclose or suggest providing for improved lateral support by using chambers in the shoe which are positioned around the periphery of the foot or a portion thereof.

U.S. Pat. No. 4,458,430 by Peterson, issued Jul. 10, 1984, discloses a shock absorbing system constructed within the sole of a shoe consisting of two interconnected, fluid-filled chambers. The chambers are positioned under the heel and arch portions of the foot. Unlike the assembly disclosed in Cole et al. above, the chambers are totally contained within the sole of the shoe, i.e., the chambers do not bulge below the sole of the shoe. The impact absorbing function initiates when the heel strikes the rear chamber and the fluid contained therein is forced to flow into the other chamber, causing it to expand. The chambers, however, provide a certain resistance to expansion. This, coupled with the somewhat restricted connecting passageways, serves to absorb some of the impact forces. The process is reversed when the forward cushion experiences an applied force. Although Peterson discloses a multi-chambered, fluidly connected impact absorbing device, the disclosure of Peterson is restricted to a system which is constructed within the shoe. A further problem with the systems disclosed by both Peterson and Cole et al. is that they provide no impact absorption if both chambers are compressed simultaneously as presumably would happen when one jumps straight up and down. Moreover, Peterson does not disclose or suggest providing improved lateral support by placing chambers in the shoe around the periphery of the foot or a portion thereof. Furthermore, Peterson does not disclose or suggest that some of the chambers exhibit self-pumping characteristics, instead requiring the application of a force to a chamber to transfer fluid to the other chamber.

In summary, the above-discussed padding devices for footwear which use a fluid medium to absorb and/or distribute impact forces are inadequate in a number of respects. Initially, many of the references disclose devices which are built into the sole of the footwear. When any portion of the shock absorbing system malfunctions or wears out, the entire shoe presumably must be replaced. In addition, none of the references appear to disclose improving the lateral support of the shoe by positioning a chamber or chambers around the periphery of the foot or a portion thereof. Furthermore, all of the references which implement interconnected, multi-chambered shock absorbing systems require that a force be exerted on or near the chambers themselves to move fluid to lower pressure regions. Therefore, if forces are not alternatively applied to each chamber in a precisely timed manner, they will not function effectively.

It would be advantageous to have a padding device which overcomes the deficiencies of known devices, namely by providing a padding device which uses fluidly communicable chambers to effectively and efficiently absorb and distribute impact forces, and which is self reinitializing for subsequent use. It would also be advantageous to provide a device which improves the lateral support of footwear for applications where such a feature would be appropriate.

SUMMARY OF THE INVENTION

In accordance with the present invention, a self-reinitializing padding device is provided which utilizes fluidly interconnected chambers containing flowable material to at least partially absorb and/or distribute forces. This self-reinitializing feature allows the present invention to be used in a wide variety of applications. The preferred application is for protecting the foot or portions thereof since this particular area is subjected to cyclic type forces during walking, jogging, or running, thereby requiring a padding device capable of rapid reinitialization to offer adequate protection. However, self-reinitialization of padding devices is also desirable in applications where the force is more random, but still repeated. For instance, the present invention may be used to protect any region of the body, such as the elbow, hand, or knee which often experience a force when engaged in various activities.

In a preferred embodiment of the present invention, there is a primary chamber which contains or is capable of containing flowable material. Positioned radially outwardly from the primary chamber are a plurality of secondary chambers which are individually connected to the primary chamber and which also contain or are capable of containing flowable material. The secondary chambers do not necessarily have to be positioned equidistant from the main chamber, but instead may be positioned to coincide with the perimeter of the region to be protected, for instance the heel in the foot pad application. In order to accommodate variations in distance from the primary chamber, the channels connecting the primary chamber to each of the secondary chambers will vary in length and cross-sectional area. The channels connecting secondary chambers which are closer to the primary chamber are shorter and have smaller cross-sectional areas than those which are located farther away from the primary chamber. This allows each secondary chamber to expand and contract at substantially the same rate as a result of intaking and exhausting flowable materials, as will be discussed below. The primary chamber, secondary chambers, and the connecting channels forming the padding device each are capable of containing flowable material, and at least one of these elements will always contain flowable material throughout operation of the padding device.

In another embodiment of the present invention there is a single, substantially tubular secondary chamber located radially outwardly from, and fluidly connected with, a primary chamber, the secondary chamber again being positionable to coincide with the perimeter of the object to be protected, for instance the heel in the foot pad application. Consequently, as above, all points on the secondary chamber may not necessarily be equidistant from the primary chamber. The plurality of interconnecting channels which connect various portions of the secondary chamber to the primary chamber thus may vary length and cross-sectional area for the same reasons discussed above. The primary chamber, secondary chamber, and the connecting channels forming the padding device are each capable of containing flowable material, and at least one of these elements will contain flowable material throughout operation of the padding device.

The padding device of the present invention absorbs and/or distributes impact forces in a similar manner, regardless of the application for which it is being used. Therefore, for the sake of simplicity, the following description will focus on just one of the many applications of the padding devices, that being when it is used as a foot pad. When the padding device is used in a footwear application, as a foot pad, either being built within the footwear or being separately insertable therewithin, the primary chamber is positioned to coincide with a certain portion of the foot, most commonly the heel. When the heel of the footwear strikes the ground, the user's heel deforms the primary chamber which forces some of the flowable material contained therein to flow to the secondary chambers. Total instantaneous deformation of the primary chamber, i.e., bottoming out, is prevented by the restrictive nature of the channels connecting the primary chamber and the secondary chambers. The rate of deformation of the primary chamber is thus greater than the rate of transfer of flowable materials to the secondary chambers through the channels. Consequently, the channels provide backpressure to the primary chamber which aids in the absorbtion of some of the impact forces. Moreover, the energy required to transfer the flowable materials to the secondary chambers dissipates some of the energy transferred at impact, as does the stretching of the secondary chambers as they receive flowable materials from the primary chamber.

Not only are some of the impact forces absorbed as described, but such forces are also distributed to the outer portions of the heel by the transfer of flowable materials from the primary chamber to each of the secondary chambers where such forces are then absorbed by the outer portions of the heel. The secondary chambers in their expanded state also provide improved lateral support since they will in essence form a barrier around the perimeter of the heel.

The materials forming the secondary chambers must allow the secondary chambers to exhibit self-pumping characteristics—that is, allow the secondary chambers to exhaust a certain volume of flowable material back to the primary chamber after the force or a portion thereof is removed from the primary chamber, without requiring the application of an external force to such secondary chambers. Consequently, since such materials are used in the present invention, when the force of the heel is removed from the primary chamber the secondary chambers act like self contained pumps and contract, having been stretched beyond their maximum unstressed volumetric capacity, and force at least some of the flowable material contained therein to flow back into the primary chamber to reinitialize the system for subsequent impact force absorbtion/distribution functions.

DETAILED DESCRIPTION OF THE INVENTION

The present invention will be described with reference to the attached figures which illustrate one configuration of the present invention. As previously discussed, the preferred application of the present invention is as a foot pad. Due to the cyclic nature of the application of forces to a foot, the self-reinitialization feature of the present invention is highly desirable when the pad is employed in footwear. However, applications where random, but still repeated, forces are experienced will also benefit from use of the present invention and its self-reinitializing feature. Such applications include those where protection is desired of a bone protuberant area, as well as other sensitive areas such as the elbow, hand, and knee, which commonly need protection when engaging in certain activities, including various sports.

Figure 1:
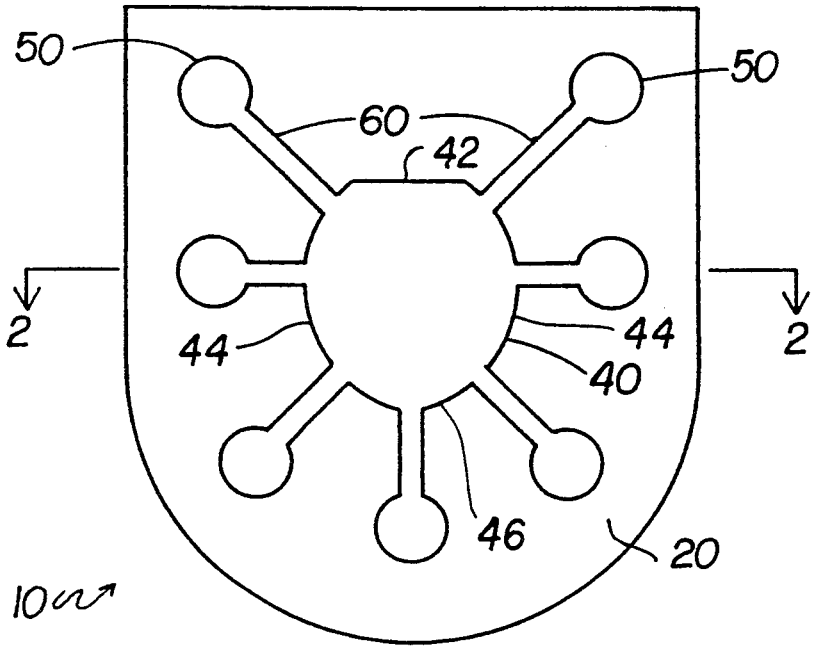
FIG. 1 is a top view of one embodiment of the present invention.
Figure 2:
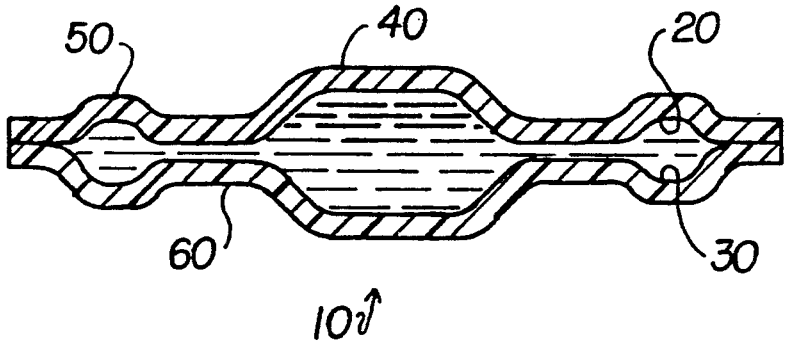
FIG. 2 is a cross-sectional view of the padding device of FIG. 1 taken along line II—II of FIG. 1.

FIGS. 1 and 2 are a top and cross-sectional view taken along line II—II of FIG. 1, respectively, of a preferred embodiment of the present invention. Padding device 10 is an enclosure formed by joining elastic material 20 to backing material 30. Backing material 30 may be either an elastic or nonelastic material. Elastic material 20 is sealed to backing material 30 in a configuration having a primary chamber 40, a plurality of secondary chambers 50 which are located radially outwardly from primary chamber 40 and which are positioned to coincide with the perimeter of the object to be protected, e.g., a heel in the foot padding device application. In this regard, the primary chamber 40 includes a front portion 42, two laterally displaced side portions 44, and a rear portion 46 which is longitudinally displaced from the front portion 42. Consequently, in the embodiment illustrated in FIG. 1, the secondary chambers 50 are positioned outwardly from the two side portions 44 and the rear portion 46 of the primary chamber 40. More particularly, at least a portion of one of the secondary chambers 50 is positioned outwardly from each of the side portions 44 at a location which is longitudinally between the front and rear portions 42, 46.

Also included in padding device 10 are a plurality of connecting channels 60 connecting each secondary chamber 50 to primary chamber 40. At least one of primary chamber 40, secondary chambers 50, and connecting channels 60 will contain flowable material, which acts as the medium for absorbing and distributing impact forces, throughout the operation of padding device 10. Each of these elements and their placement in the configuration will be discussed in more detail below to illustrate the attendant advantages of the present invention, namely a padding device which is self-reinitializing and which offers improved force absorbtion and distribution characteristics. Further, in appropriate applications such as when the padding device of the present invention is used to protect the foot, it also offers improved lateral support.

Padding device 10 is an enclosure formed by sealing elastic material 20 to backing material 30 in the desired configuration, namely primary chamber 40, secondary chambers 50, and connecting channels 60. Elastic material 20 can be any pliable, lightweight material which has a certain degree of elasticity, as well as a high resistance to puncturing. As will be discussed in more detail below regarding the interaction of the elements of padding device 10, elastic material 20 is specifically needed in order for secondary chambers 50 to be able to pump flowable materials back into primary chamber 40 without requiring the exertion of a force on secondary chambers 50 (i.e., the device is self-reinitializing). Examples of materials which are suitable for elastic material 20 include polyurethane or polyvinyl (e.g. polyvinylchloride) materials, acetals; acrylics; cellulosics; chlorinated polyethers; fluorocarbons, such as polytetrafluorethylene (TFE), polychlorotrifluoro-ethylene (CTEE), and fluorinated ethylene propylene (FEP); nylons (polyamides); polycarbonates; polyethylenes (including copolymers); polybutylenes; polypropylenes; polystyrenes; polyesters; and polysulfones; the preferred material being polyurethane. Depending on the resistance to puncturing of the particular material selected, the thickness of elastic material 20 will typically range from about 0.1 millimeters to about 0.5 millimeters.

Backing material 30 may be any pliable, lightweight material which is either elastic or nonelastic and which has a high resistance to puncturing. In the preferred embodiment of the invention, backing material 30 will be a pliable, lightweight, substantially nonelastic material such as urethane laminate, the preferred material being a nylon reinforced urethane. However, backing material 30 can also be elastic and exhibit the same or similar characteristics as those materials identified as being suitable for elastic material 20. Again, depending upon the resistance to puncturing of the selected material, the thickness of backing material 30 will typically range from about 0.1 millimeters to about 0.5 millimeters.

In the preferred embodiment of the present invention illustrated in FIGS. 1 and 2, primary chamber 40 is substantially centrally located on padding device 10. However, primary chamber 40 can be positioned anywhere on padding device 10 to accommodate the cushioning of any desired object or portion of the human anatomy. Primary chamber 40 is shown as being semicircular in shape, the semi-circle being closed on the forward portion of padding device 10 by a line which connects two points on the semi-circle. The radius of the semi-circular portion of primary chamber 40 in the foot pad application will generally range from about 20 millimeters to about 40 millimeters. Primary chamber 40 is capable of containing flowable material and will generally have an amount of flowable material, when not being subjected to an applied force, occupying about 50 to about 100 percent of the volume of primary chamber 40. Primary chamber 40 will have a thickness generally ranging from about 2 millimeters to about 10 millimeters when containing this volume of flowable material. Although primary chamber 40 has been described in detail as to the shape and dimensions thereof as illustrated in FIGS. 1 and 2, it is to be expressly recognized that the size and shape of primary chamber 40 can be modified to accommodate protection of any object for which padding is desired, i.e., the configuration may be tailored to the desired use.

In the preferred embodiment of the invention illustrated in FIGS. 1 and 2, secondary chambers 50 are located radially outwardly from primary chamber 40 and are positioned to coincide with the perimeter of the object to be protected, in this case the heel of a foot. In this particular application (foot pad) all secondary chambers 50 are not equidistant from primary chamber 40. Each secondary chamber 50 is substantially circular in shape, having a diameter typically ranging from about 5 millimeters to about 30 millimeters. Secondary chambers 50 are capable of containing flowable material and when at their maximum volume, generally 100% of the volume of such secondary chambers 50 will be occupied by such flowable materials. When at their normal maximum volume, such as when a force has been fully applied to primary chamber 40, secondary chambers 50 will have a thickness ranging from about 2 millimeters to about 10 millimeters. However, it is to be understood that not all secondary chambers 50 will contain the same amount of flowable material at all times due to the placement of the force on primary chamber 40, i.e., an off-center placement of a force on primary chamber 40 generally will cause more flowable materials to flow into those secondary chambers 50 nearest the application of such force. Although the preferred embodiment of secondary chambers 50 have been described as having such shape and dimensions, it is to be expressly recognized that any shape and dimension of secondary chambers 50 can be utilized. Moreover, the placement of secondary chambers 50 will depend upon the particular application with which padding device 10 is being used, particularly the shape of the region to be protected.

In the preferred embodiment of the present invention shown in FIGS. 1 and 2, connecting channels 60 connect each secondary chamber 50 to primary chamber 40. The connecting channels 60 are not necessarily the same length, since secondary chambers 50 do not have to be equidistant from primary chamber 40. The cross-sectional area of connecting channels 60 depends on the distance between the particular secondary chamber 50 and the primary chamber 40. Secondary chambers 50 that are closer to primary chamber 40 will have connecting channels 60 that are shorter and a cross-sectional area which is smaller than those connecting channels 60 which connect secondary chambers 50 which are located farther away from primary chamber 40. This is to ensure that each secondary chamber 50 expands and contracts at substantially the same rate when a force has been centrally applied to primary chamber 40. In the preferred embodiment of the present invention, the cross-sectional diameter of connecting channels 60 will range from about 1 millimeter to about 15 millimeters. Channels 60 are also capable of containing flowable material and will generally have 100 percent of their volume occupied when a force is being applied to primary chamber 40.

Figure 3:
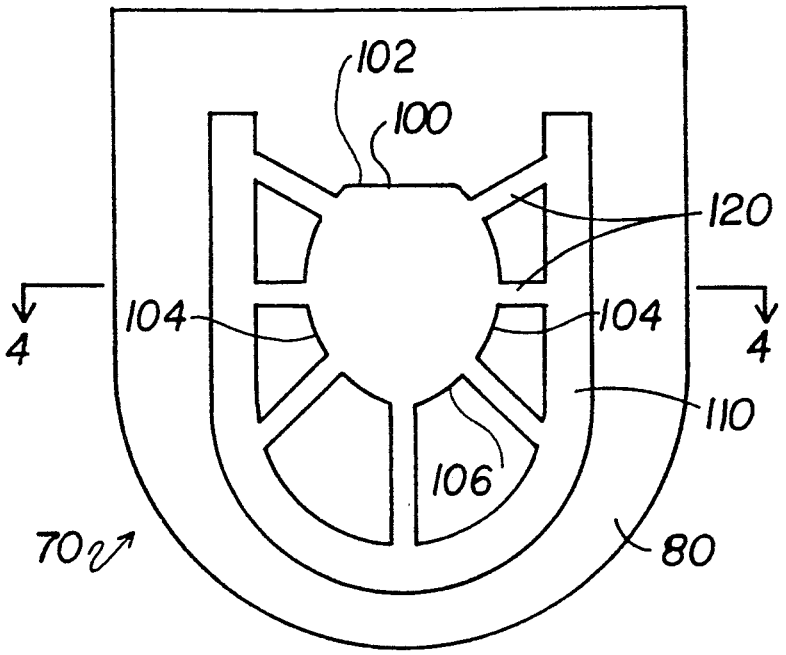
FIG. 3 is a top view of another embodiment of the present invention.
Figure 4:
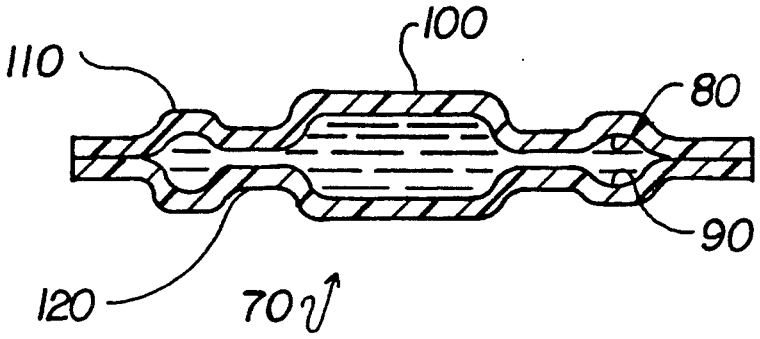
FIG. 4 is a cross-sectional view of the padding device of FIG. 3 taken along line IV—IV of FIG. 3.

Another embodiment of the present invention is illustrated in FIGS. 3 and 4, FIG. 3 being a top view of padding device 70 and FIG. 4 being a cross-sectional view of FIG. 3 taken along line IV—IV. Padding device 70 is an enclosure formed by joining elastic material 80 to backing material 90, both of which have characteristics similar to elastic material and backing material 30 in the preferred embodiment discussed above. Elastic material 80 is sealed to backing material 90 in a configuration having a primary chamber 100, having a front portion 102, two laterally displaced side portions 104, and a rear portion 106 longitudinally displaced from the front portion 102, secondary chamber 110, and a plurality of connecting channels 120 connecting secondary chamber 110 to primary chamber 100 in a plurality of locations. At least one of primary chamber 100, secondary chamber 110, and connecting channels 120 will contain flowable material, which acts as the shock absorbing and distributing medium, throughout the operation of padding device 70. Each of these elements and their positioning in the configuration will be discussed in more detail below to better illustrate the attendant advantages of the present invention.

Padding device 70 is an enclosure formed by sealing elastic material 80 to backing material 90 in the desired configuration, namely primary chamber 100, secondary chamber 110, and connecting channels 120. Elastic material 80, backing material 90, primary chamber 100, and connecting channels 120 all have the same or similar features, characteristics, and positioning in the configuration as the corresponding elements of the preferred embodiment. However, secondary chamber 110 in this embodiment differs from secondary chambers 50 of the preferred embodiment in certain respects.

In the embodiment of the present invention illustrated in FIGS. 3 and 4, secondary chamber 110 is a single enclosure which is positioned radially outwardly from primary chamber 100 to coincide with the perimeter of the object to be protected. In this regard, at least a portion of the secondary chamber 110 is positioned outwardly from the two side portions 104 of the primary chamber 100 at a location which is longitudinally between the front and rear portions 102, 106 of the primary chamber 100, with portions of the secondary chamber 110 also being positioned outwardly from the rear portion 106 of the primary chamber 100. All points on secondary chamber 110 need not necessarily be equidistant from primary chamber 100. Consequently, connecting channels 120 may have varying lengths and cross-sectional areas similar to connecting channels 60 in the preferred embodiment. Secondary chamber 110 is somewhat tubular in shape and is capable of containing flowable material which generally occupies 100 percent of the volume of certain sections of secondary chamber 110 when a force is being applied to primary chamber 100. However, it is to be understood that the application of an off-center force on primary chamber 100 will affect the flow of flowable material into secondary chamber 110 as discussed above.

The flowable materials useful in the present invention can be any liquid. Preferred liquids are those having a viscosity ranging from about 0.8 centipoise to about 15,000 centipoise. Examples of suitable liquids include glycerin, water, oils, fats, greases, and the like. In order to reduce the overall weight of the padding device, small, lightweight particles may be included in the flowable material to reduce its total density. Preferred materials include: (1) mixtures of wax, oil, and spherical particles; and (2) mixtures of water and/or glycerine, a viscosity-increasing agent (for example, guar, agar, polyethylene oxide or cellulose materials such as carboxymethylcellulose, hydroxypropylcellulose and hydroxyethylcellulose or mineral thickeners such as attapulgite clays (e.g. Attagel TM) and fumed silica (e.g. Cab-O-Sil TM)), and spherical particles.

Regarding the method of constructing both embodiments of the present invention, reference will only be made to the preferred embodiment since the method of construction is the same although the specific configurations of various embodiments are different. Elastic material 20 is affixed to backing material 30, preferably by heat sealing the materials or by using other methods known to those skilled in the art, to form a configuration comprised of a primary chamber 40, a plurality of secondary chambers 50, and connecting channels 60 joining each secondary chamber 50 to primary chamber 40. A small opening is left in the enclosure for insertion of a filling apparatus into the formed enclosure. The filling device is thereafter inserted into the opening and a predetermined volume of flowable material is placed therein, the volume of fluid inserted ranging from about 20 to about 100 percent of the total available volume of primary chamber 40, secondary chambers 50, and connecting channels 60. When the desired volume has been injected, the filling device is removed and the opening between elastic material 20 and backing material 30 is sealed.

The above-described structural characteristics of both padding device 10 and padding device 70 allows the present invention to be used in a wide variety of applications where it is desirable to have a padding device which, after being subjected to a force and absorbing and/or distributing at least a portion of the force, will reinitialize itself for subsequent use. This self-reinitializing feature is particularly desirable for applications in which repeated or cyclic forces are applied. Consequently, the preferred application of the present invention is as a foot padding device. In this application, certain portions of the foot, such as the heel and the ball, are subjected to these types of repeated forces when walking, jogging or running.

Other applications for the present invention would include those in which the applied force(s) may not necessarily be as cyclic as those produced by walking, jogging, or running. For instance, the present invention would be suitable for offering protection to participants of many sporting activities. In this regard, the present invention may be used as an elbow, knee, or hand pad. Depending upon the portion of the body to be protected, regardless of the activity, whether it be sporting or otherwise, the configuration of the present invention may be modified accordingly. More particularly, the sizes, shapes, and positions of elements of the present invention may be specifically tailored for the intended end use. The general force absorbtion and distribution characteristics of the present invention, particularly the manner of reinitialization, is also similar regardless of the particular application for which it is being used.

In the preferred embodiment of the invention, padding device 10 is inserted into footwear. However, it is to be expressly understood that padding device 10 can also be incorporated into the construction of the footwear. Primary chamber 40 is positioned to cushion a certain portion of the user's foot, most commonly the heel. As the user moves about, the heel exerts a force on primary chamber 40. The exertion of this force deforms primary chamber 40 which forces some of the flowable material contained therein to flow through connecting channels 60 into the plurality of secondary chambers 50 positioned around the perimeter of the heel. Total instantaneous deformation of primary chamber 40, i.e., bottoming out, is prevented by the restrictive nature of connecting channels 60. The rate of deformation of primary chamber 40 produced by the application of the force is greater than the rate of flow out of primary chamber 40 through connecting channels 60 into secondary chambers 50. Channels 60 are specifically designed so that the total volume of flowable materials contained in primary chamber 40 cannot be displaced instantaneously through channels 60. Connecting channels 60, therefore, provide back-pressure to primary chamber 40, which in conjunction with the initial deformation of primary chamber 40, provides one way in which padding device 10 absorbs impact forces.

Although the flowable material contained in primary chamber 40 does not instantaneously flow into secondary chambers 50 when a force is initially exerted on primary chamber 40, flow from primary chamber 40 will continue into secondary chambers 50 until either the force is removed from primary chamber 40 or it is substantially emptied of flowable material. The energy required to transfer such flowable materials dissipates a portion of the impact forces. As flowable material from primary chamber 40 flows into secondary chambers 50, elastic material 20, which forms a portion of secondary chambers 50, allows for the expansion thereof. This expansion of secondary chamber 50 also dissipates some of the energy transferred to padding device 10 by the impact forces. As the force continues to be applied to primary chamber 40, the volume increase in secondary chambers 50 will also result in some of the impact forces being distributed to the outer portions of the heel.

The expansion of secondary chambers 50 in the above-described manners serves another function in addition to absorbing and distributing impact forces. Immediately prior to the time when the heel will be lifted from the surface, thereby removing the applied force, the heel will be fully seated in primary chamber 40. Coinciding with this depression of primary chamber 40 is the forming of a barrier around the outer contours of the foot, more particularly the heel, as a result of expansion of secondary chambers 50. This barrier around the outer contour of the foot, in conjunction with the heel being fully seated in primary chamber 40, provides improved lateral support for the footwear.

When the force is removed from primary chamber 40 by the heel lifting from the contacted surface, padding device 10 provides a means for reinitializing the system to allow for repetition of the above-described method for absorbing and distributing impact forces. As described above, secondary chambers 50, due to the elasticity of elastic material 20, expand from an increase in volume when a force is applied to primary chamber 40. When the force is removed from primary chamber 40 (the heel coming off of the ground), elastic material 20 forming secondary chambers 50 will contract and attempt to substantially retain its original shape and volume. When secondary chambers 50 contract in this manner, they act as individual pumps, and as a result some of the flowable material contained in secondary chambers 50 is forced to flow back into primary chamber 40. After all secondary chambers 50 have contracted in this manner, all or a substantial portion of the volume of flowable material initially present in primary chamber 40 before impact is placed back into primary chamber 40. Padding device 10 is then ready for subsequent cycles of absorbtion and distribution of impact forces.

The attendant advantages with both embodiments of the present invention are not achievable by known padding devices. The concept of using a plurality of secondary chambers or a single secondary chamber positioned radially outwardly from a primary chamber provides a means for distributing impact forces over a broader area. As described above, as the secondary chamber(s) expand and receive flowable material from the primary chamber, some of the impact forces directed upon the primary chamber is transferred to the outer secondary chamber(s). Therefore, since the force is applied over a larger area, the pressure experienced by a particular object is decreased.

Another attendant advantage of the present invention is the positioning of the secondary chamber(s). As stated above, the secondary chamber(s) may be located radially outwardly from the primary chamber and positioned to coincide with the perimeter of the object to be protected. This is desirable in some applications, primarily the foot pad application. For instance, when used as a heel pad, the heel depresses the primary chamber and seats itself therein and the flowable material is forced to flow into the secondary chamber(s). When the heel is totally depressed in the primary chamber, the volume of flowable material in the secondary chamber(s) is at a maximum volume. In essence, a barrier is then formed by the secondary chamber(s) which surrounds the outer portion of the heel, thereby improving the lateral support of the footwear which thus decreases the likelihood of injuring an ankle or a knee, which is a prime consideration in athletic shoes.

Another attendant advantage of the present invention relates to those characteristics possessed by the secondary chambers. The elastic materials forming the secondary chamber(s) allows the secondary chamber(s) to expand and contract as forces are applied and removed from the primary chamber. Expansion of the secondary chambers dissipates some of the energy transferred to the padding device at impact and distributes these impact forces over a larger area.

With further regard to the secondary chambers, the ability of the secondary chamber(s) to contract without requiring the application of a force thereon, a direct result of the elasticity of the materials forming the secondary chambers, allows the secondary chambers to behave like pumps to reinitialize the system by transferring flowable materials back to the primary chamber. Consequently, the padding device can be used on limited areas, such as the heel, which experience essentially only a single force and thus does not require the placement of a second chamber in another region which also experiences an applied force to properly function.

While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the claims which follow below.

What is claimed is:

1. A padding device, comprising:

a) a primary chamber having a front portion, two laterally displaced side portions, and a rear portion longitudinally displaced from said front portion;

b) at least one secondary chamber having at least a portion positioned outwardly from each of said two side portions longitudinally between said front and rear portions;

c) means for fluidly connecting said primary chamber with said at least one secondary chamber; and d) a flowable material contained within said padding device;

wherein said flowable material is capable of flowing out of said primary chamber and into said at least one secondary chamber upon application of a force to said primary chamber and wherein said at least one secondary chamber is capable of transferring at least a portion of said flowable material back into said primary chamber upon removal of at least a portion of the force from said primary chamber.

2. The padding device of claim 1, wherein said at least one secondary chamber is positioned radially outward from said two side portions and said rear portion of said primary chamber.

3. The padding device of claim 2, wherein a first portion of said at least one secondary chamber is positioned along a first radii extending from said primary chamber and a second portion of said at least one secondary chamber is positioned along a second radii extending from said primary chamber, said first and second portions being positioned at different radial distances from said primary chamber.

4. The padding device of claim 1, wherein said connecting means includes a plurality of conduits connecting a plurality of locations on said at least one secondary chamber to said primary chamber.

5. The padding device of claim 4, wherein the cross-sectional area of each of said conduits is dependent upon the length of a particular said conduit, the cross-sectional area being larger for longer said conduits.

6. The padding device of claim 1, wherein a plurality of said secondary chambers are positioned radially outward from said two side portions and said rear portion of said primary chamber.

7. The padding device of claim 6, wherein at least one of said plurality of secondary chambers is positioned at a different radial distance from said primary chamber than another of said plurality of secondary chambers.

8. The padding device of claim 6, wherein said connecting means includes a conduit connecting each of said plurality of said secondary chambers to said primary chamber.

9. The padding device of claim 8, wherein the cross-sectional area of each of said conduits is dependent upon the length of a particular said conduit, the cross-sectional area being larger for longer said conduits.

10. A heel padding device for use with footwear, comprising:

a) a primary chamber designed to coincide with the heel of a foot, wherein said primary chamber covers about 30 to 100 percent of the inner portion of the heel, and wherein said primary chamber has at least a front portion, a rear portion, and two side portions;

b) a plurality of secondary chambers positioned radially outward from said primary chamber and along at least portions of said two side portions and said rear portion;

c) a conduit connecting each of said plurality of secondary chambers to said primary chamber; and d) a flowable material contained within said padding device;

wherein said flowable material is capable of flowing out of said primary chamber and into at least one of said plurality of secondary chambers when a force is applied to said primary chamber and wherein said secondary chambers are capable of forcing at least a portion of said flowable material back into said primary chamber when at least a portion of the force is removed from said primary chamber.

11. A method of absorbing and distributing impact forces, comprising:

a) providing a primary chamber having a front portion, two laterally displaced side portions, and a rear portion longitudinally displaced from said front portion, wherein said primary chamber contains a flowable material;

b) positioning a plurality of secondary chambers around at least a portion of said primary chamber, at least a portion of one of said plurality of secondary chambers being positioned outwardly from each of said two side portions longitudinally between said front and rear portions, wherein said plurality of secondary chambers are each fluidly connected to said primary chamber;

c) impacting said primary chamber with a force;

d) deforming said primary chamber to transfer at least a portion of said flowable material from said primary chamber into at least one of said plurality of secondary chambers to absorb at least a portion of the force transferred to said primary chamber at impact, wherein the rate of deformation of said primary chamber is greater than the flow rate into said at least one of said plurality of secondary chambers;

e) expanding said at least one of said plurality of secondary chambers upon receipt of said flowable material from said primary chamber to absorb at least a portion of the force transferred to said primary chamber at impact; and f) contracting said at least one of said plurality of secondary chambers when at least a portion of the force is removed from said primary chamber to transfer at least a portion of said flowable material contained in said at least one of said plurality of secondary chambers back into said primary chamber.

12. The method of claim 11, further including the step of positioning said primary chamber over at least a portion of a foot.

13. The method of claim 11, further including the step of positioning said primary chamber over at least a portion of the heel of a foot.

14. The method of claim 11, further including the step of positioning said primary chamber over at least a portion of the metatarsal ball region of a foot.

15. The method of claim 11, further including the step of positioning said primary chamber over at least a portion of a protuberant bone.

16. The method of claim 11, further including the step of positioning said primary chamber over at least a portion of a knee.

17. The method of claim 11, further including the step of positioning said primary chamber over at least a portion of a hand.

18. The method of claim 11, further including the step of positioning said primary chamber over at least a portion of an elbow.

19. A method of reinitializing a padding device subjected to a force, comprising:

a) providing a primary chamber having a perimeter defined by at least a front portion, a rear portion, and two side portions, wherein said primary chamber contains a flowable material;

b) positioning at least one secondary chamber radially outward from at least portions of said rear portion and said two side portions, wherein said at least one secondary chamber is fluidly connected to said primary chamber;

c) impacting said primary chamber;

d) deforming said primary chamber to force at least a portion of said flowable material into said at least one secondary chamber to absorb at least a portion of the force transferred to said primary chamber upon impact;

e) expanding said at least one secondary chamber upon receipt of said flowable material from said primary chamber, wherein at least a portion of the force transferred to said primary chamber at impact is absorbed; and f) contracting said at least one secondary chamber when at least a portion of said force is removed from said primary chamber to force at least a portion of said flowable material from said at least one secondary chamber back into said primary chamber.

20. The method of claim 19, further including the step of positioning said primary chamber over at least a portion of a foot.

21. The method of claim 19, further including the step of positioning said primary chamber over at least a portion of the heel of a foot.

22. The method of claim 19, further including the step of positioning said primary chamber over at least a portion of the metatarsal ball region of a foot.

23. The method of claim 19, further including the step of positioning said primary chamber over at least a portion of a protuberant bone.

24. The method of claim 19, further including the step of positioning said primary chamber over at least a portion of a knee.

25. The method of claim 19, further including the step of positioning said primary chamber over at least a portion of a hand.

26. The method of claim 19, further including the step of positioning said primary chamber over at least a portion of an elbow.

27. A padding device, comprising:

a) a primary chamber;

b) at least one secondary chamber;

c) means for connecting said primary chamber and said secondary chamber, wherein said connecting means includes a plurality of conduits connecting a plurality of locations on said secondary chamber to said primary chamber, and wherein the cross-sectional area of each of said conduits is dependent upon the length of a particular said conduit, the cross-sectional area being larger for longer said conduits; and d) a flowable material contained within said padding device;

wherein said flowable material is capable of flowing out of said primary chamber and into said secondary chamber upon application of a force to said primary chamber and said secondary chamber is capable of forcing said flowable material back into said primary chamber upon removal of at least a portion of the force from said primary chamber.

28. A padding device, comprising:

a) a primary chamber, said primary chamber being positioned to cushion at least a portion of a foot;

b) a plurality of secondary chambers positioned radially outward from said primary chamber along a perimeter of said portion;

c) means for connecting said primary chamber and said secondary chambers, wherein said connecting means includes a conduit connecting each of said secondary chambers to said primary chamber, and wherein the cross-sectional area of each of said conduits is dependent upon the length of a particular said conduit, the cross-sectional area being larger for longer said conduits; and d) a flowable material contained within said padding device, wherein said flowable material is capable of flowing out of said primary chamber and into said secondary chambers upon application of a force to said primary chamber, and wherein said secondary chambers are capable of forcing at least a portion of said flowable material back into said primary chamber upon removal of at least a portion of the force from said primary chamber.

* * * * *